US009793079B2

(12) United States Patent
Kubono et al.

(10) Patent No.: US 9,793,079 B2
(45) Date of Patent: Oct. 17, 2017

(54) ELECTROMAGNETIC RELAY

(71) Applicant: FUJITSU COMPONENT LIMITED, Tokyo (JP)

(72) Inventors: Kazuo Kubono, Tokyo (JP); Takashi Yuba, Tokyo (JP); Yoichi Hasegawa, Tokyo (JP); Takuji Murakoshi, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 300 days.

(21) Appl. No.: 14/659,728

(22) Filed: Mar. 17, 2015

(65) Prior Publication Data

US 2015/0187527 A1 Jul. 2, 2015

Related U.S. Application Data

(63) Continuation of application No. PCT/JP2013/075089, filed on Sep. 18, 2013.

(30) Foreign Application Priority Data

Sep. 21, 2012 (JP) ..... 2012-208950

(51) Int. Cl.
*H01H 9/00* (2006.01)
*H01H 51/04* (2006.01)
(Continued)

(52) U.S. Cl.
CPC ..... *H01H 51/04* (2013.01); *H01H 50/021* (2013.01); *H01H 50/042* (2013.01);
(Continued)

(58) Field of Classification Search
USPC ..... 361/139, 144, 160
See application file for complete search history.

(56) References Cited

U.S. PATENT DOCUMENTS 3,839,690 A 10/1974 Kobler et al.
4,692,730 A 9/1987 Muller
(Continued)

FOREIGN PATENT DOCUMENTS

CN 101677044 3/2010
CN 201608110 U 10/2010
(Continued)

OTHER PUBLICATIONS

International Search Report dated Dec. 10, 2013.

*Primary Examiner* — Danny Nguyen
(74) *Attorney, Agent, or Firm* — IPUSA, PLLC

(57) ABSTRACT

An electromagnetic relay includes a fixed contact, a movable contact corresponding to the fixed contact, a movable element that retains the movable contact and moves in a contacting direction and a separating direction relative to the fixed contact, an axial core coupled to the movable element, a movable core coupled to the axial core to move in the contacting direction and the separating direction relative to a movement of the axial core, a driving part that drives the movable core in the contacting direction, an urging part that exerts force to the axial core in the separating direction, and a constraining part that constrains the relative movement of the axial core in the separating direction.

12 Claims, 9 Drawing Sheets

(51) Int. Cl.

| | |
|---|---|
| ***H01H 50/44*** | (2006.01) |
| ***H01H 50/04*** | (2006.01) |
| ***H01H 51/06*** | (2006.01) |
| ***H01H 50/18*** | (2006.01) |
| ***H01H 50/36*** | (2006.01) |
| ***H01H 50/02*** | (2006.01) |
| ***H01H 50/20*** | (2006.01) |
| *H01H 50/64* | (2006.01) |

(52) U.S. Cl.

CPC ..... *H01H 50/18* (2013.01); *H01H 50/20* (2013.01); *H01H 50/36* (2013.01); *H01H 50/44* (2013.01); *H01H 51/065* (2013.01); *H01H 50/648* (2013.01); *H01H 2050/446* (2013.01); *H01H 2205/002* (2013.01); *H01H 2235/01* (2013.01); *H01H 2235/03* (2013.01)

(56) References Cited

U.S. PATENT DOCUMENTS 5,892,194 A * 4/1999 Uotome ..... H01H 1/34 218/68
6,204,742 B1 3/2001 Hisamoto et al.
6,265,957 B1 7/2001 Baginski et al.
7,859,373 B2 * 12/2010 Yamamoto ..... H01H 50/305 335/126
2004/0027776 A1 * 2/2004 Uotome ..... H01H 47/06 361/160
2006/0050466 A1 * 3/2006 Enomoto ..... H01H 50/02 361/160
2011/0080240 A1 4/2011 Patino et al.
2012/0162847 A1 6/2012 Suzuki et al.

FOREIGN PATENT DOCUMENTS

| | | |
|---|---|---|
| EP | 2333803 | 6/2011 |
| JP | S53-006564 U | 1/1978 |
| JP | 2001-103724 | 4/2001 |
| JP | 2003-184710 | 7/2003 |
| JP | 4078820 | 4/2008 |
| JP | 2011-146134 | 7/2011 |

* cited by examiner

ELECTROMAGNETIC RELAY

CROSS-REFERENCE TO RELATED APPLICATIONS

This application is a U.S. continuation application filed under 35 USC 111(a) claiming benefit under 35 USC 120 and 365(c) of PCT application PCT/JP2013/075089, filed Sep. 18, 2013, which claims priority to Application Ser. No. 2012-208950, filed in Japan on Sep. 21, 2012. The foregoing application is hereby incorporated herein by reference.

FIELD

The embodiments discussed herein are related to an electromagnetic relay. The electromagnetic relay is used for domestic, industrial, and in-vehicle purposes.

BACKGROUND

In an electromagnetic relay, electric current flows or be interrupted from flowing through an electric circuit by opening and closing a contact. The contact includes a fixed contact and a movable contact. The electromagnetic relay includes a mechanism for moving the movable contact toward or away from the fixed contact. As an example of a mechanism for displacing the movable contact, Patent Document 1 discloses a so-called plunger (moving core) type electromagnetic relay.

[Patent Document 1]: Japanese Patent No. 4078820

In the electromagnetic relay disclosed in Patent Document 1, a shaft is inserted in a through-hole provided in a moving core and is temporarily fastened to the moving core with a screw. Then, the moving core and the shaft are integrated by laser welding. However, such temporary fastening for welding the moving core and the shaft increases the number of components and the number of manufacturing steps. This leads to an increase in manufacturing cost.

SUMMARY

According to an aspect of the invention, there is provided an electromagnetic relay including a fixed contact, a movable contact corresponding to the fixed contact, a movable element that retains the movable contact and moves in a contacting direction and a separating direction relative to the fixed contact. An axial core is coupled to the movable element, a movable core is coupled to the axial core to move in the contacting direction and the separating direction relative to a movement of the axial core, a driving part drives the movable core in the contacting direction, an urging part exerts force to the axial core in the separating direction, and a constraining part constrains the relative movement of the axial core in the separating direction.

DESCRIPTION OF EMBODIMENTS

In the following, embodiments of the present invention are described with reference to the accompanying drawings.

First Embodiment

Figure 1:
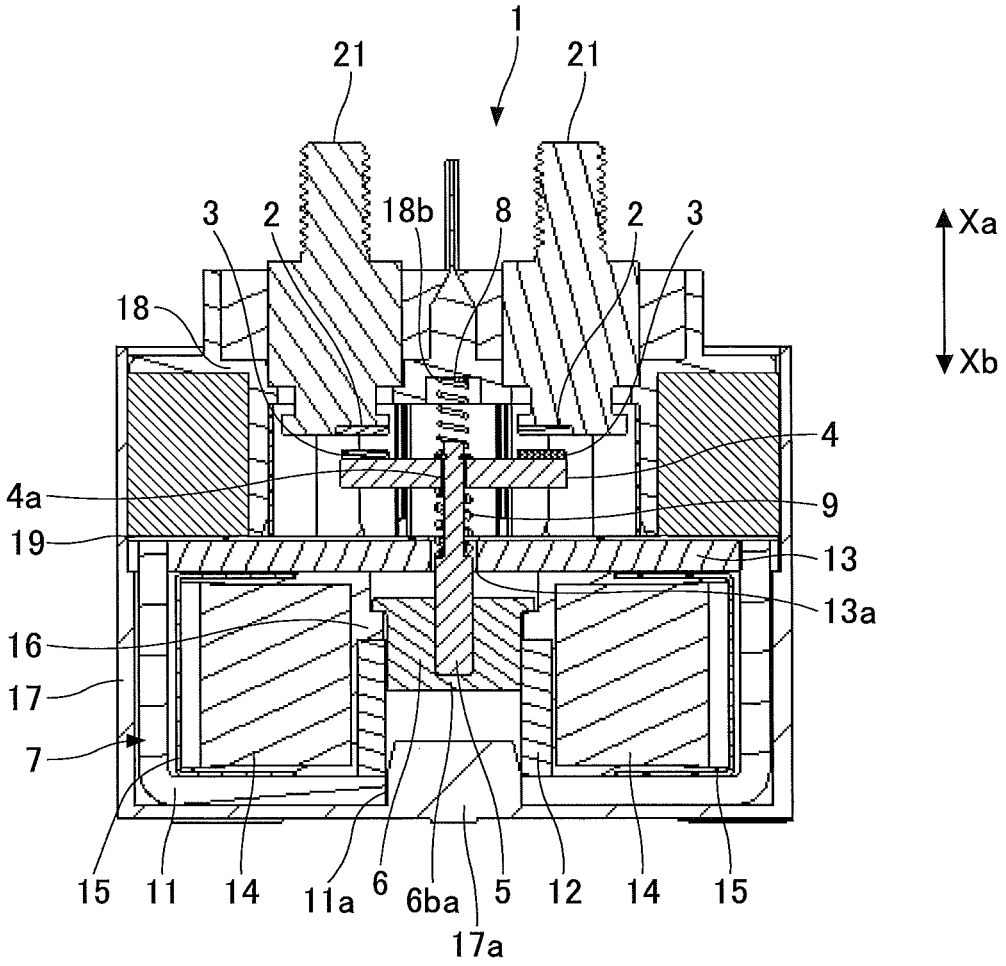
FIG. 1 is a cross section of an electromagnetic relay according to a first embodiment of the present invention taken along a central axis line of a shaft.

As illustrated in FIG. 1, the electromagnetic relay 1 of the first embodiment includes a pair of fixed contacts 2, a pair of movable contacts 3 that can be moved relative to the fixed contacts 2 in a contacting/separating direction Xa-Xb, a movable element 4 that supports the movable contacts 3 and moves in the contacting/separating direction Xa-Xb, a shaft (an example of axial core) 5 coupled to the movable element 4, and a plunger (an example of movable core) 6 that is coupled to, and is movable relative in the direction Xa-Xb to, the shaft 5.

The electromagnetic relay also includes a driving part 7 that drives the plunger 6 to move in a contacting direction Xa (upward in FIG. 1), a recovery spring (an example of urging part) 8 that urges the shaft 5 in a separating direction Xb (downward in FIG. 1), a constraining part that constrains the movement of the shaft 5 relative to the plunger 6 in the separating direction Xb, and a pressure spring 9 that urges the movable element 4 in the contacting direction Xa.

Figure 2:
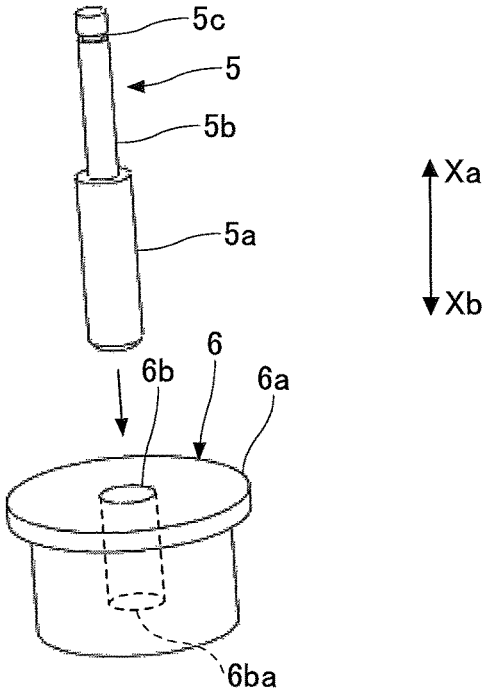
FIG. 2 is a schematic diagram illustrating the coupling of the shaft and a plunger of the electromagnetic relay of the first embodiment.
Figure 3:
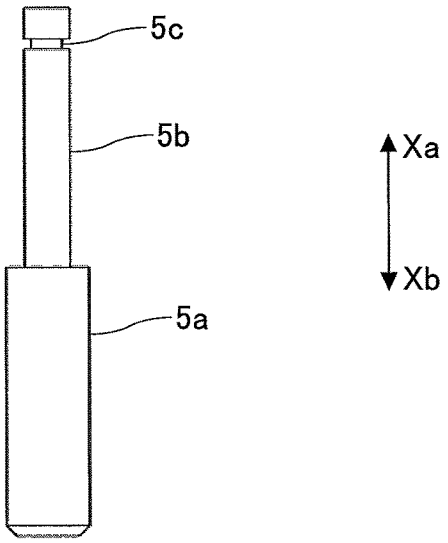
FIG. 3 is a schematic diagram illustrating the shaft of the electromagnetic relay of the first embodiment viewed from its radial direction.

The constraining part of this embodiment includes an opening 6*b* for inserting an insertion part 5*a* of the shaft 5 therethrough as illustrated in FIG. 2. The opening 6*b* is formed with a closed end by perforating a cylindrical plunger 6 from the side of a flange 6*a* of the plunger 6. The constraining part of this embodiment also includes a bottom 6*ba*. As illustrated in FIG. 2, the shaft 5 includes a small diameter part 5*b* for installing the pressure spring 9 provided in the side of the contacting direction Xa of the insertion part 5*a*. The small diameter part 5*b* has a diameter smaller than the insertion part 5*a* as illustrated in FIGS. 2 and 3. The shaft 5 also includes a groove 5*c* formed close to an end of the small diameter part 5*b*.

Figure 4:
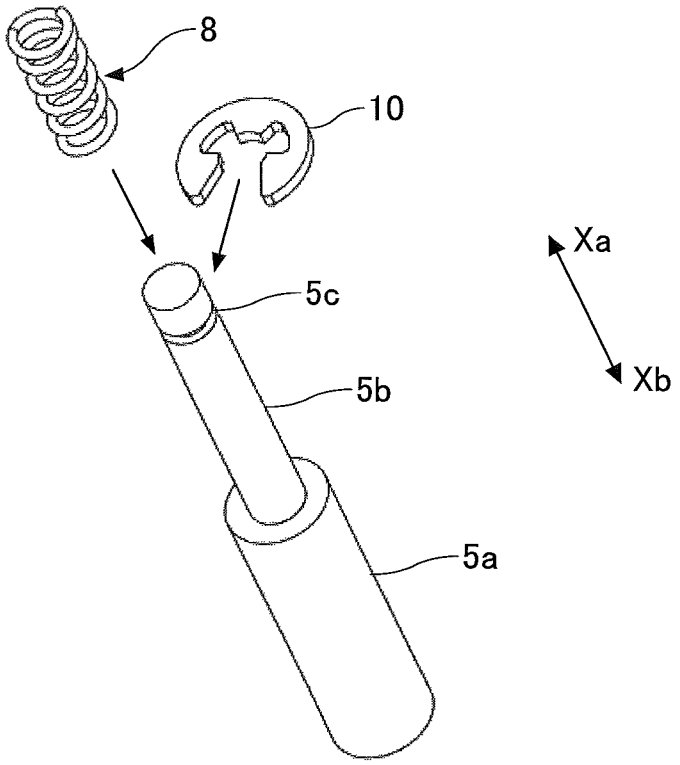
FIG. 4 is a schematic diagram illustrating the coupling of the shaft and a recovering spring of the electromagnetic relay of the first embodiment.

As illustrated in FIG. 4, the groove 5*c* extending in a circumferential direction is formed on an end of the shaft 5 (upper end in FIG. 4) in the contacting direction Xa. An E-ring (an example of plate part) 10 is engaged to the groove 5*c*. The E-ring 10 functions as an engaging part that engages an end of the recovery spring 8 in the separating direction Xb. For example, a JIS standard E-type retaining ring may be used as the E-ring 10. The E-ring 10 includes an inner peripheral part contacting an outer peripheral surface of the groove 5*c* and an outer peripheral part contacting the end of the recovery spring 8 in the separating direction Xb.

The electromagnetic relay 1 of the first embodiment includes an insulating barrier 15 that ensures insulation between the yokes 11-13 constituting the driving part 7 and an electric coil wiring 14 as illustrated in FIG. 1. Each of the yokes 11-13 constitutes a part of a magnetic circuit. The electromagnetic relay 1 also includes a reel-like bobbin (an example of wound part) 16 around which the electric coil wiring 14 is wound. In this embodiment, target engagement parts 16*a* are formed in two parts of the bobbin 16 as illustrated in (a) of FIG. 5. The target engagement parts 16*a* have concave sector shapes to be engaged with the insulating barrier 15 at an outer side thereof in its radial direction. The insulating barrier 15 includes an engagement part that engages the target engagement part 16*a*.

Figure 5:
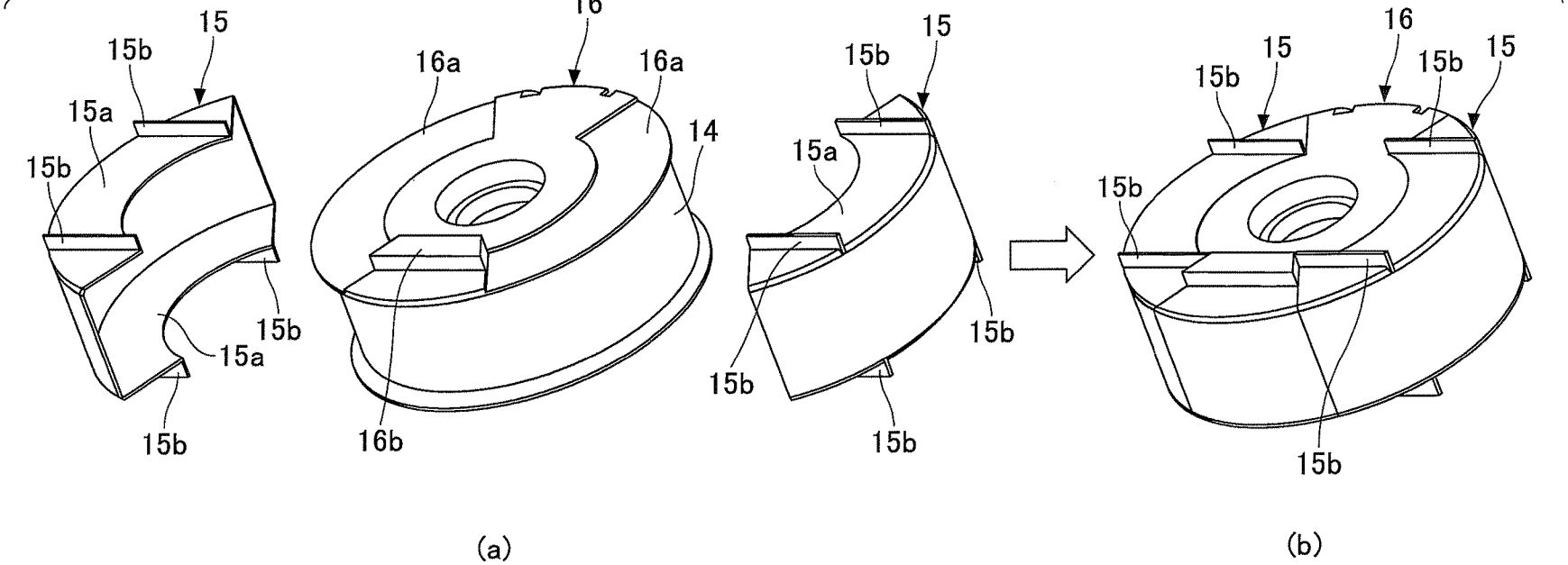
FIG. 5 is a schematic diagram illustrating an insulating barrier of the electromagnetic relay of the first embodiment.

As illustrated in (a) of FIG. 5, the insulating barrier 15 has a hollow sector-pillar shape that is concaved at an inner side thereof in its radial direction and includes a sector surface 15*a* forming an engagement part with another sector surface 15*a* on its opposite side. Two insulating barriers 15 are provided for the bobbin 16. A pair of planar constraining parts 15*b* are arranged in parallel on upper and lower surfaces of each insulating barrier 15, so that the bobbin 16 is constrained from moving in a circumferential direction of the bobbin 16 relative to the yokes 11, 13 having a part extending_in a radial direction of the bobbin 16. The insulating barriers 15 and the bobbin 16 are formed of, for example, a synthetic resin.

The pair of sector-shaped target engagement parts 16*a* are arranged at equal intervals in a circumferential direction of the bobbin 16. When the insulation barriers 15 are engaged to corresponding target engagement parts 16*a* from the outside in the radial direction, the four constraining parts 15*b* on the upper side form a configuration that sandwiches the planar yoke 13 (see FIG. 1) therebetween whereas the four constraining parts 15*b* on the lower side form a configuration that sandwiches the planar U-shaped yoke 11 illustrated in (a) of FIG. 6. The insulation barriers 15 are arranged to be interposed between the electric coil wiring 14 and an area in a circumferential direction of the electromagnetic relay 1 having the yokes 11, 13 extending in this area of the electromagnetic relay 1.

The electromagnetic relay 1 of the first embodiment includes a driving part housing 17, a contact housing 18, and a connection housing 19 as illustrated in FIG. 1. The driving part housing 17 may be formed of, for example, a mold resin. As illustrated in (a) of FIG. 6, the driving part housing 17 has a close-ended box-like shape for encasing the driving part 7 therein. The connection housing 19 and the contact housing 18 may also be formed of, for example, mold resin.

A cylindrical projection 17*a* is provided at a bottom of the driving part housing 17. A hole 11*a* having a diameter greater than the diameter of the projecting part 17*a* is provided in the U-shaped planar yoke 11. A groove 17*b* is also provided in the bottom of the driving part housing 17. The groove 17*b* has a width that is substantially equal to a width W of the yoke 11 and a depth that is less than a thickness T of the yoke 11. In this embodiment, the total dimension of the depth of the groove 17*b* and the height of the constraining part 15*b* is adjusted to be less than or equal to the thickness of the yoke 11.

Figure 6:
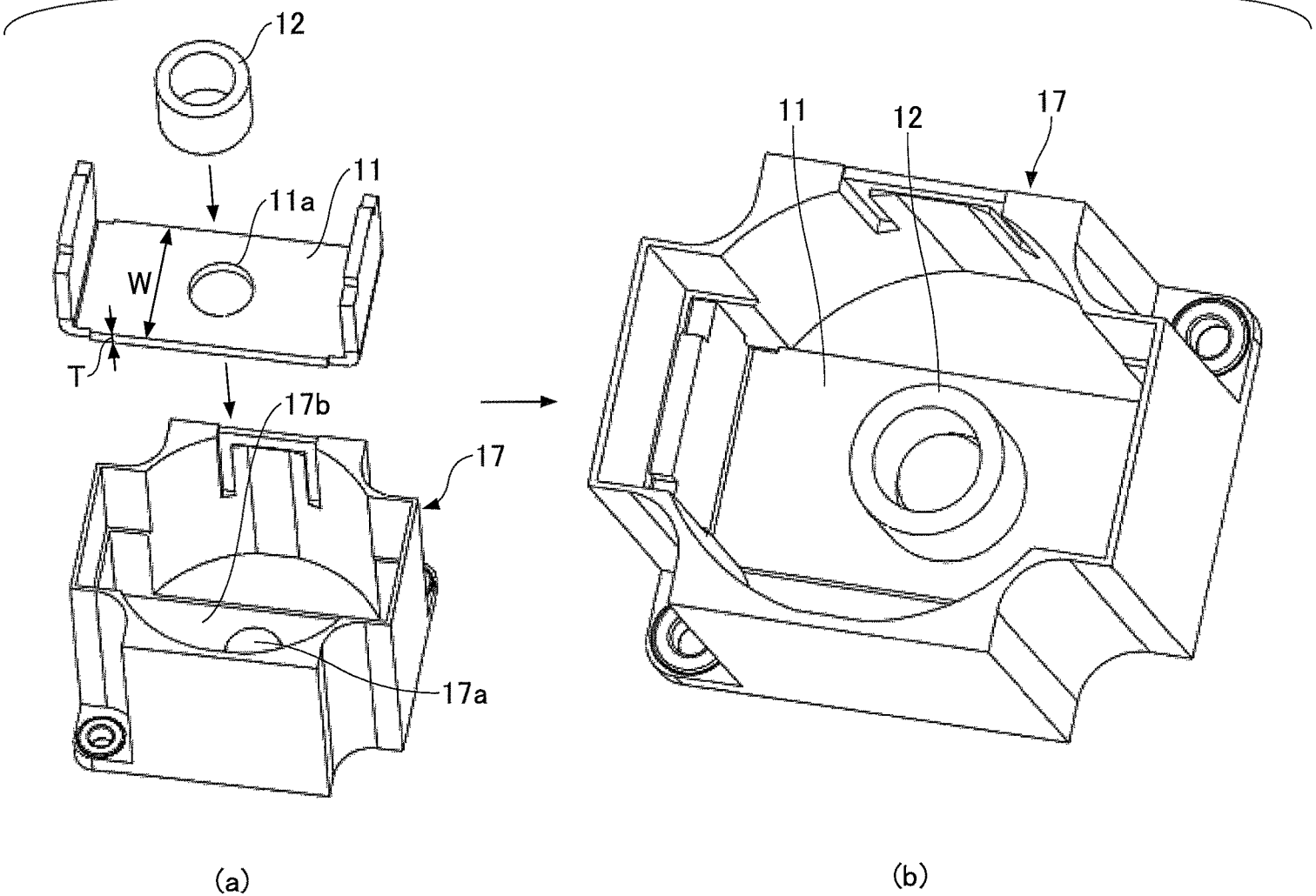
FIG. 6 is a schematic diagram illustrating the assembling of a driving part housing and yokes of the electromagnetic relay of the first embodiment.

When the yoke 11 and the cylindrical yoke 12 are mounted to the housing 17 in the arrow direction illustrated in (a) of FIG. 6, the projecting part 17*a* is inserted through the hole 11*a* and then inserted through an inner periphery of the yoke 12. As illustrated in (b) of FIG. 6, the position of the yoke 12 is defined by the projecting part 17 inserted therethrough, and the position of the yoke 11 is defined in a manner sandwiched between both sidewalls of the groove 17.

Figure 7:
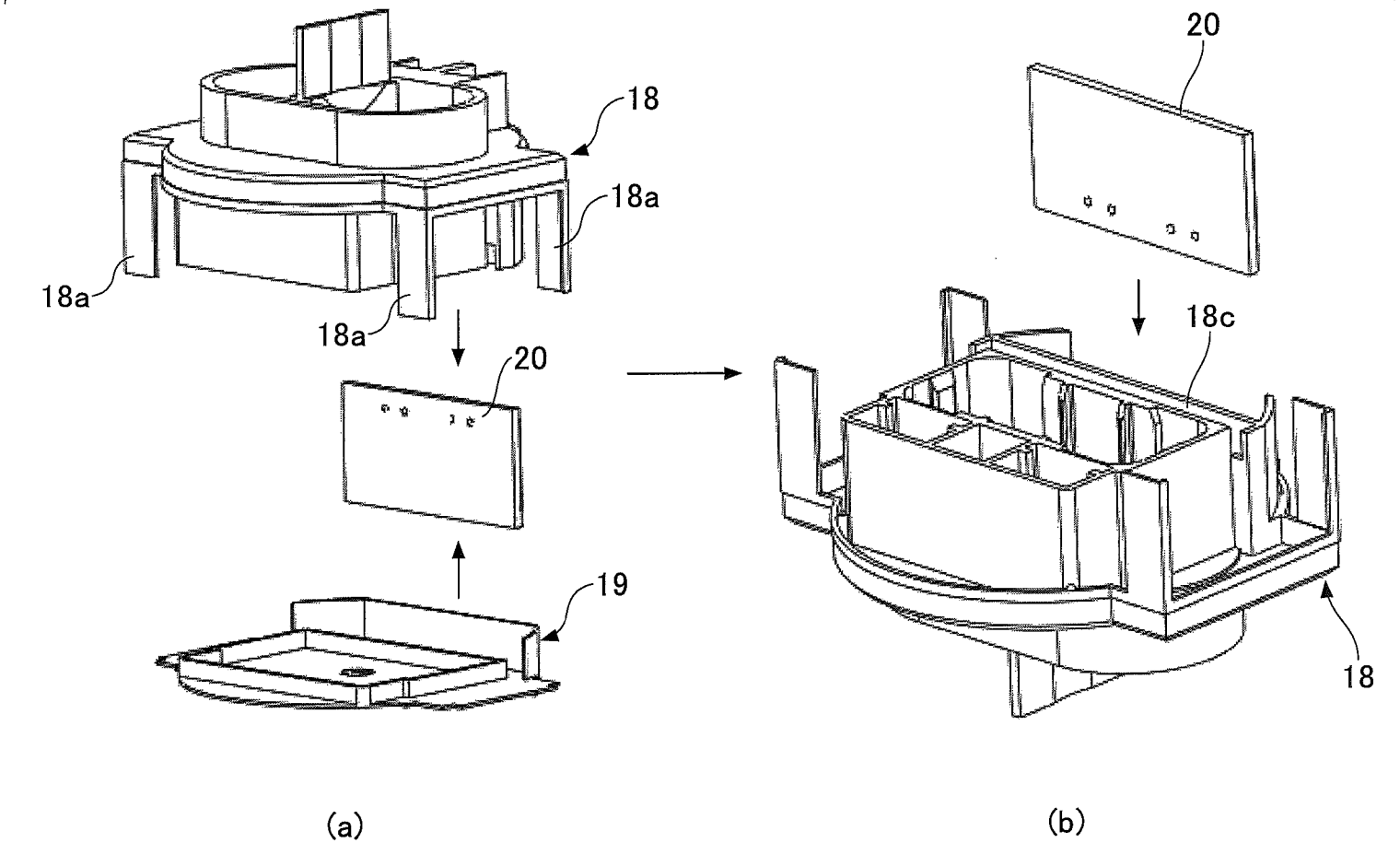
FIG. 7 is a schematic diagram illustrating the assembling of a contact housing, a connection housing, and a PWM control circuit of the electromagnetic relay 1 of the first embodiment.

Then, the bobbin 16 being engaged with the insulation barriers 15 as illustrated in (b) of FIG. 5 is inserted into the driving part housing 17 from above in (b) of FIG. 6, and the assembly in which the plunger 6 and the shaft 5 are assembled are inserted into the yoke 12. Then, the yoke 13 including a hole 13*a* for inserting the shaft 5 therethrough is mounted on the bobbin 16, and the shaft 5 is inserted through the hole 13*a*. Thereby, the driving part 7 is assembled. Then, a planar connection housing 19 having a shape for engaging the contact housing 18 as illustrated in (a) of FIG. 7 is mounted on the driving part housing 17. A trapezoidal protrusion 16*b* that is formed on the upper side of the bobbin 16 (see (a) of FIG. 5) defines the position of the connection housing 19 with respect to the bobbin 16 when mounting the connection housing 19 on the driving part housing 17.

Then, the pressure spring 9 is inserted through the small diameter part 5*b* of the shaft 5 in which a hole 4*a* of the movable element 4 is engaged with the small diameter part 5*b*. Then, the E-ring 10 is engaged with the groove 5*c* that is formed at the end of the small diameter part 5*b*, and the end of the recovery spring 8 to the side of the separating direction Xb contacts the outer peripheral part of the E-ring 10.

Figure 8:
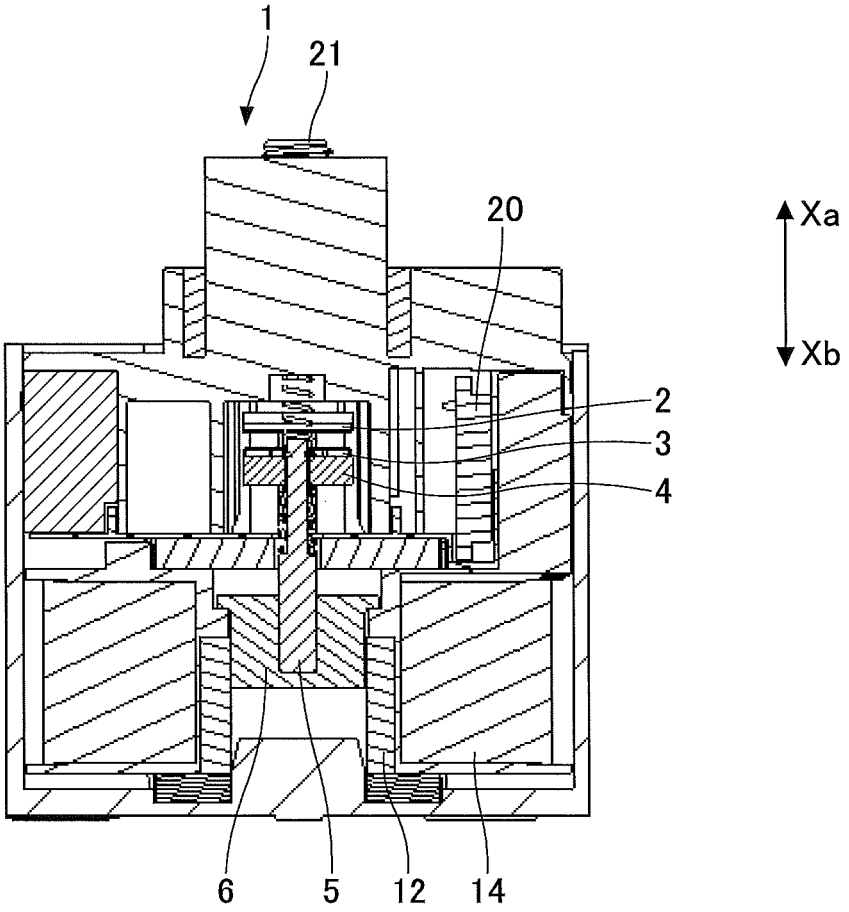
FIG. 8 is a schematic diagram illustrating the positioning of the PWM control circuit inside a space for installing a fixed contact and a movable contact of the electromagnetic relay of the first embodiment.

As illustrated in FIG. 1, the contact housing 18 fixes a pair of columnar fixed terminals 21 each of which having a fixed contact 2 at its end. The contact housing 18 is inserted into the driving part housing 17 through an opening of the driving part housing 17, and legs 18*a* of the contact housing 18 are engaged with the driving part housing 17. Thereby, the fixed contacts 2 are arranged facing the movable contacts 3. After the end of the recovery spring 8 to the side of the contacting direction Xa is fixed to an opening 18*b* provided on the contact housing 18, the contact housing 18 and the driving part housing 17 are hermetically sealed to each other by using an adhesive, welding, or soldering. As illustrated in (b) of FIG. 7, the contact housing 18 includes an installing part 18*c* for installing a PWM control circuit substrate (drive circuit) 20 that drives the driving part 7. The PWM control circuit 20 is provided in an installing space for installing the fixed contact 2 and the movable contact 3 as illustrated in FIG. 8.

Figure 9:
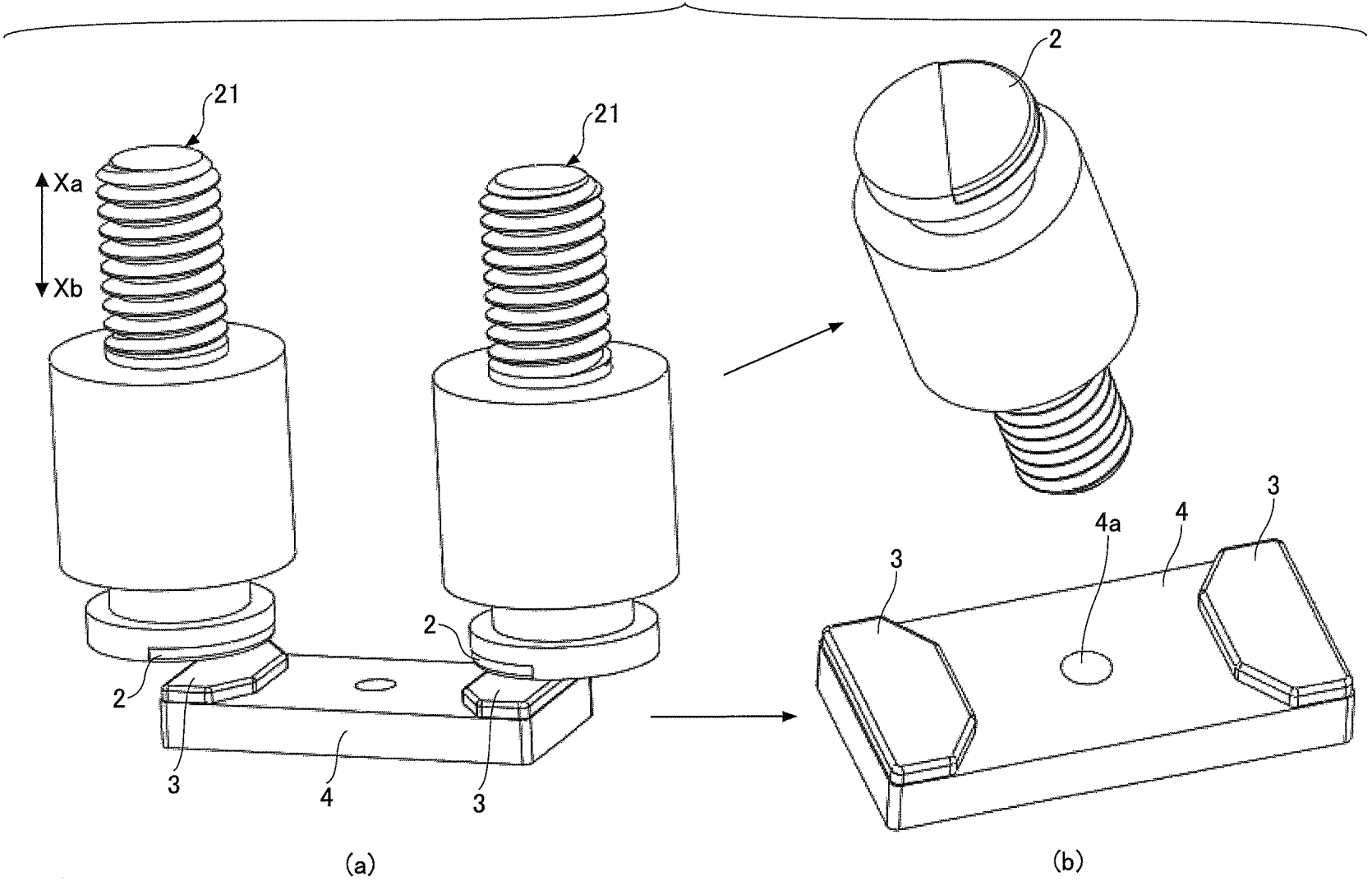
FIG. 9 is a schematic diagram illustrating a configuration of a fixed terminal, the fixed contact, and the movable contact of the electromagnetic relay of the first embodiment.

In this embodiment, the fixed terminal 21 corresponds to the fixed contact 2 as illustrated in FIG. 9. The fixed contact 2 is only provided on the end of the fixed terminal 21 at the separating direction Xb and an area facing the movable contact 3. The movable element 4 has a planar shape extending in both ways in a radial direction of the shaft 5. One movable contact 3 is provided on both ends of the movable element 4, respectively. The contact 3 has a hexagonal shape formed by cutting two corners of a longitudinal side of a rectangle. The fixed contact 2 has a semi-circular shape that circumscribes the hexagonal contact 3.

The electromagnetic relay 1 of the first embodiment is a 1-form-X plunger type relay having a pair of contacts as described above. In the first embodiment, a pair of fixed terminals 21 of FIG. 1 is inserted into any part of a direct current circuit to be connected/disconnected, and a terminal of the electric coil wire of the driving part 7 is connected to an input/output interface of the PWM control circuit 20, so that excitation current can be suitably controlled.

In a state where excitation current is not applied to the terminal of the driving part 7, the shaft 5 is exerted downwardly as illustrated in FIG. 1 by the resilient force of the recovery spring 8, so that the fixed contact 2 and the movable contact 3 shift to an open state that are not contacting each other, or the open state is maintained. In the state illustrated in FIG. 1, the end of the insertion part 5*a* at the separating direction Xb exerts pressure to the bottom 6*ba* of the plunger 6 in a downward direction in FIG. 1 by the resilient force of the recovery spring 8. By the exerting pressure from the shaft 5, the flange 6*a* of the plunger 6 contacts a step formed in the bobbin 16, and the bottom 6*ba* of the plunger 6 maintains a state contacting the end of the insertion part 5*a* of the shaft 5.

When excitation current is applied to the terminal of the driving part 7, an attracting force is generated by the electric coil wire 14 and the yokes 11-13 to attract the plunger 6 in the contacting direction Xa and cause the bottom 6*ba* of the plunger 6 to exert pressure to the end of the insertion part 5*a* of the shaft 5. Thereby, the shaft 5 and the movable element 4 are moved upward, so that the fixed contact 2 and the movable contact 3 shift to a closed state that are contacting each other, or the closed state is maintained.

With the electromagnetic relay 1 of the first embodiment, the following effects can be attained. Owing to the configuration having the insertion part 5*a* of the shaft 5 inserted into the close-ended opening 6*b* of the plunger 6, contact between the bottom 6*ba* and the end of the insertion part 5*a* can be ensured by using the resilient force of the recovery spring 8 when excitation current is not applied whereas the contact between the bottom 6*ba* and the end of the insertion part 5*a* can be ensured by using the electromagnetic force that attracts the plunger 6 in the contacting direction Xa when excitation current is applied. That is, the procedure of securely fixing the shaft 5 and the plunger 6 by welding, using an adhesive, or the like after temporarily fastening the shaft 5 and the plunger 6 can be omitted. Thereby, simplification of the manufacturing process and cost reduction can be achieved.

Dynamic coupling between the end of the recovery spring 8 to the side of the separating direction Xb and the end of the shaft 5 to the side of the contacting direction Xa can be easily achieved by engaging the groove 5*c* of the small diameter part 5*b* of the shaft 5 to a commonly used E-ring 10. That is, the processing procedures such as changing the shape of the end of the small diameter part 5*b* of the shaft 5 for coupling with the recovery spring 8 or inserting a pin for receiving the end of the shaft 5 into an opening provided in a radial direction of the small diameter part 5*b* can be omitted.

By placing the insulating barrier 15 along the areas in which the yoke 11 and the yoke 13 extend, the insulating performance between the electric coil wire 14 and the magnetic circuit can be enhanced. That is, even if a sufficient insulating distance cannot be obtained due to downsizing of the electromagnetic relay 1, a reliable insulating property can be attained by placing the insulating barrier 15. Further, the constraining part 15*b* of the insulating barrier 15 defines the positioning between the bobbin 16 and the driving part housing 17 interposed by the yoke 11 and the positioning between the bobbin 16 and the connection housing 19 interposed by the yoke 13. Because a reliable insulating property can be attained, the PWM control unit 20 can be easily installed in the contact housing 18, and centralization of components can be achieved.

By arranging the fixed contact 2 only in a part of the end of the fixed terminal 21 that faces the movable contact 3, the volume of the material used for forming the fixed contact 2 can be reduced to achieve cost reduction. Particularly, cost reduction can be achieved significantly in a case where a noble metal system is used as the fixed contact 2.

Second Embodiment

Figure 10:
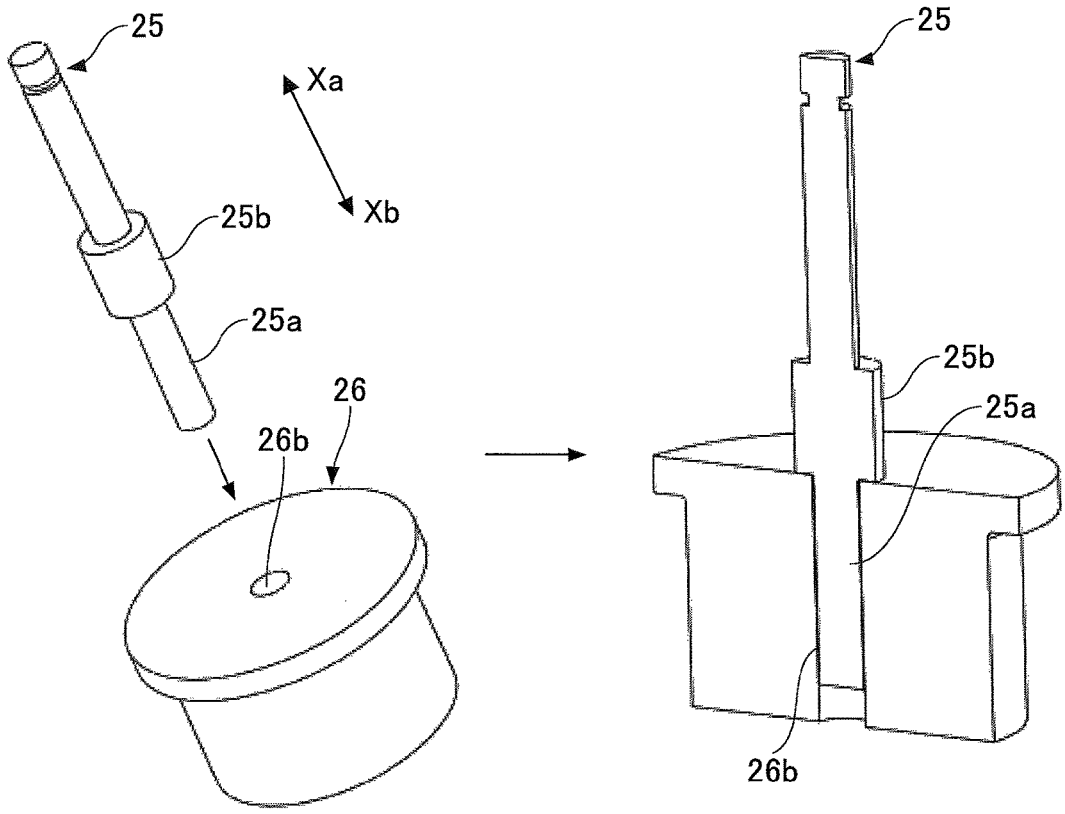
FIG. 10 is a schematic diagram illustrating the coupling of a shaft and a plunger of the electromagnetic relay according to a second embodiment of the present invention.

Unlike the constraining part of the electromagnetic relay 1 of the first embodiment, a constraining part of the second embodiment includes a shaft 25 and a through-hole 26*b* as illustrated in FIG. 10. The shaft 25 includes an insertion part 25*a* and a large diameter part 25*b* having a diameter greater than the diameter of the insertion part 25*b*. The through-hole 26*b* for inserting the insertion part 25*a* therethrough is formed by perforating a plunger 26.

Similar to the first embodiment, the electromagnetic relay of the second embodiment can ensure contact between an end of the large diameter part 25*b* toward the separating direction Xb and an surface of the plunger 26 toward the contacting direction Xa by using the resilient force of the recovery spring 8 when excitation current is not applied whereas the contact between the end of the large diameter part 25*b* and the surface of the plunger 26 can be ensured by using the electromagnetic force that attracts the plunger 26 in the contacting direction Xa when excitation current is applied. That is, similar to the first embodiment, the procedure of securely fixing the shaft 25 and the plunger 26 by welding, using an adhesive, or the like after temporarily fastening the shaft 25 and the plunger 26 can be omitted. Thereby, simplification of the manufacturing process and cost reduction can be achieved. With the second embodiment, the processing of the plunger 26 is easier compared to the processing of the close-ended plunger 6 because the through-hole 26*b* is formed by simply perforating the plunger 26. Thereby, further cost reduction can be achieved.

The embodiments of the present invention are related to an electromagnetic relay that can be manufactured with a simple structure, so that cost reduction and downsizing can be achieved. Therefore, the electromagnetic relay according to the embodiments of the present invention is suitably used for domestic, industrial, and in-vehicle purposes.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

The invention claimed is:

1. An electromagnetic relay comprising:

a fixed contact;

a movable contact corresponding to the fixed contact;

a movable element that retains the movable contact and moves in a contacting direction and a separating direction relative to the fixed contact;

an axial core including a first terminal end, a second terminal end opposite to the first terminal end, and a first portion to which the movable element is coupled, the first portion being positioned between the first terminal end and the second terminal end;

a movable core coupled to the first terminal end of the axial core to move in the contacting direction and the separating direction relative to a movement of the axial core;

a driving part that drives the movable core in the contacting direction;

an urging part that exerts force to the axial core in the separating direction; and a constraining part that constrains the relative movement of the axial core in the separating direction, wherein the urging part is coupled to a second portion of the axial core, the second portion being positioned between the first portion and the second terminal end of the axial core.

2. The electromagnetic relay as claimed in claim 1, wherein the movable core includes a close-ended opening for inserting the axial core therethrough.

3. The electromagnetic relay as claimed in claim 1, wherein the movable core includes a through-hole, and wherein the axial core includes an insertion part to be inserted into the through-hole, and a large diameter part having a diameter larger than a diameter of the insertion part.

4. The electromagnetic relay as claimed in claim 1, wherein the axial core has an engaging part on the other end for engaging the urging part.

5. The electromagnetic relay as claimed in claim 4, wherein the axial core includes a groove provided in the second portion, and wherein the engaging part includes a plate that engages the groove.

6. The electromagnetic relay as claimed in claim 1, wherein the driving part includes a yoke, an electric coil wiring, and an insulating barrier that insulates the yoke and the electric coil wiring.

7. The electromagnetic relay as claimed in claim 6, wherein the driving part further includes a wound part around which the electric coil wiring is wound, wherein the wound part includes a target engagement part to which the insulating barrier is engaged, and wherein the insulating barrier includes an engaging part for engaging the target engagement part.

8. The electromagnetic relay as claimed in claim 7, wherein the insulating barrier has a hollow sector-pillar shape and includes a sector surface part.

9. The electromagnetic relay as claimed in claim 8, wherein the yoke includes an extending part extending in a radial direction of the wound part, and wherein the insulating barrier includes a constraining part that constrains a movement of the extending part with respect to a circumferential direction of the wound part.

10. The electromagnetic relay as claimed in claim 1, wherein the driving part further includes a drive circuit for driving the drive part, and wherein the drive circuit is arranged in an installing space for installing the fixed contact and the movable contact.

11. The electromagnetic relay as claimed in claim 1, wherein the movable element has a plate-like shape extending in a radial direction of the axial core, wherein the movable contact is provided on both ends of the movable element.

12. An electromagnetic relay comprising:

a fixed contact;

a movable contact;

a movable element that retains the movable contact;

an axial core including a first terminal end, a second terminal end opposite to the first terminal end, and a first portion to which the movable element is coupled, the first portion being positioned between the first terminal end and the second terminal end;

an urging part that exerts force to the axial core in a direction that the movable contact separates from the fixed contact;

an electromagnet that generates a magnetic force when electrically charged; and a movable core coupled to the first terminal end of the axial core;

wherein the urging part is coupled to a second portion of the axial core, the second portion being positioned between the first portion and the second terminal end of the axial core, and the magnetic force generated by the electrical charging of the electromagnet attracts the movable core to drive the axial core and cause the movable element to move in a direction that the movable contact contacts the fixed contact.

* * * * *